US010201193B2

(12) United States Patent
Denogean et al.

(10) Patent No.: US 10,201,193 B2
(45) Date of Patent: Feb. 12, 2019

(54) BRASSIERE

(71) Applicants: Romy Denogean, Camarillo, CA (US); David J. McKinley, Chanhassen, MN (US)

(72) Inventors: Romy Denogean, Camarillo, CA (US); David J. McKinley, Chanhassen, MN (US)

( * ) Notice: Subject to any disclaimer, the term of this patent is extended or adjusted under 35 U.S.C. 154(b) by 0 days.

(21) Appl. No.: 15/483,350

(22) Filed: Apr. 10, 2017

(65) Prior Publication Data

US 2018/0289078 A1 Oct. 11, 2018

(51) Int. Cl.

| | |
|---|---|
| ***A41C 3/12*** | (2006.01) |
| ***A41C 3/00*** | (2006.01) |
| ***A41C 3/06*** | (2006.01) |

(52) U.S. Cl.

CPC ..... *A41C 3/124* (2013.01); *A41C 3/0021* (2013.01); *A41C 3/065* (2013.01); *A41C 3/0007* (2013.01); *A41C 3/06* (2013.01)

(58) Field of Classification Search

CPC ..... A41C 3/124; A41C 3/122; A41C 3/0021; A41C 3/065

USPC ..... 450/41, 45–48, 51, 52; 2/255–258

See application file for complete search history.

(56) References Cited

U.S. PATENT DOCUMENTS 1,472,796 A * 11/1923 Fritz ..... A41C 3/124 450/48
1,792,384 A * 2/1931 Madsen ..... A41C 3/124 450/45
1,837,958 A * 12/1931 Ferrero ..... A41C 3/124 450/46
2,380,978 A * 8/1945 Licht ..... A41C 3/124 450/52
2,463,319 A * 3/1949 Schwartz ..... A41C 3/124 450/45
2,480,049 A * 8/1949 Rosenberg ..... A41C 3/124 450/45
2,483,367 A * 9/1949 Glick ..... A41C 3/124 184/55.1
2,537,831 A * 1/1951 Hunau ..... A41C 3/06 450/48
2,588,603 A * 3/1952 Anderson ..... A41C 3/06 450/48
2,605,463 A * 7/1952 Hirschberg ..... G01S 7/20 342/142
2,678,445 A * 5/1954 Tagliero ..... A41C 3/122 2/256
2,731,640 A * 1/1956 Garson ..... A41C 3/124 2/257
2,769,180 A * 11/1956 Tareau ..... A41C 3/124 450/45
2,923,300 A * 2/1960 Ots ..... A41C 3/122 450/45
4,531,525 A * 7/1985 Richards ..... A41C 3/0014 450/65
5,527,202 A * 6/1996 Morgan ..... A41C 3/124 450/41
5,946,944 A * 9/1999 Osborne ..... A41C 3/0014 450/92
6,019,662 A * 2/2000 Fildan ..... A41C 3/124 2/255

(Continued)

*Primary Examiner* — Gloria Hale
(74) *Attorney, Agent, or Firm* — Inskeep IP Group, Inc.

(57) ABSTRACT

A brassiere is provided that remains hidden even when wearing evening dresses having low-plunging necklines and/or backs.

19 Claims, 5 Drawing Sheets

(56) References Cited

U.S. PATENT DOCUMENTS

| | | | | |
|---|---|---|---|---|
| 6,332,825 | B1 * | 12/2001 | Henricksen | A41C 3/0057 450/1 |
| 2004/0244418 | A1 * | 12/2004 | Smith | A41B 9/002 63/1.11 |
| 2015/0208735 | A1 * | 7/2015 | Buescher | A41C 3/12 450/86 |
| 2016/0165963 | A1 * | 6/2016 | Buescher | A41C 3/12 450/1 |

* cited by examiner

FIG. 3
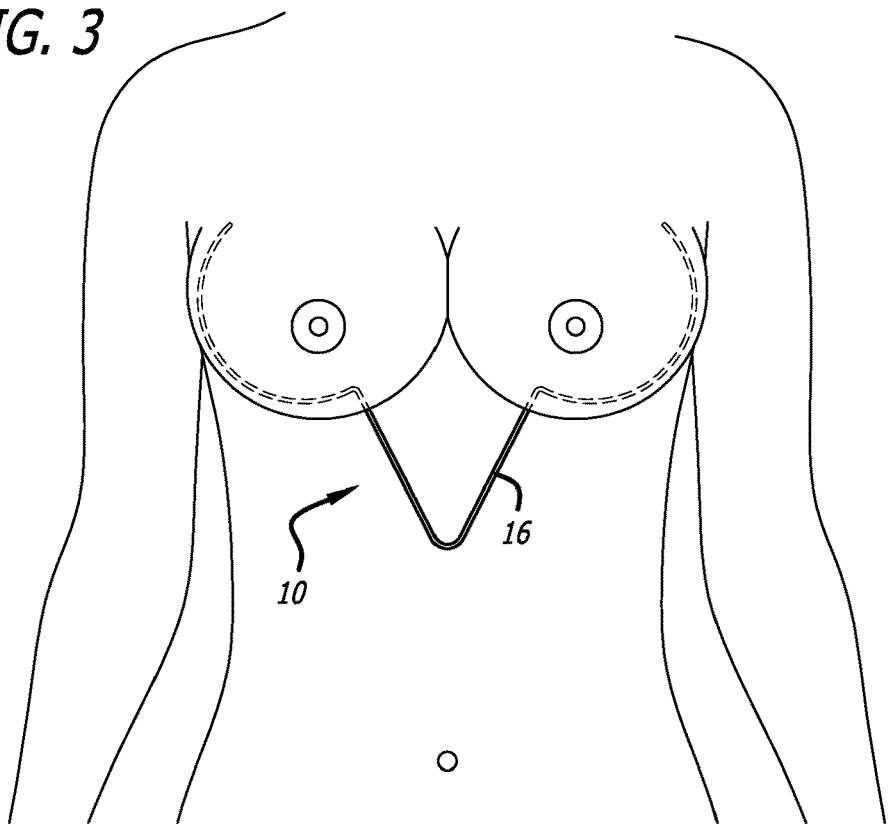
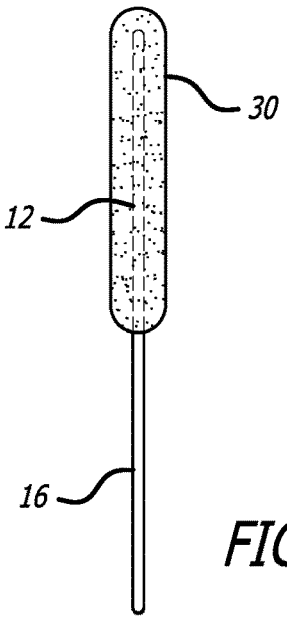
FIG. 4

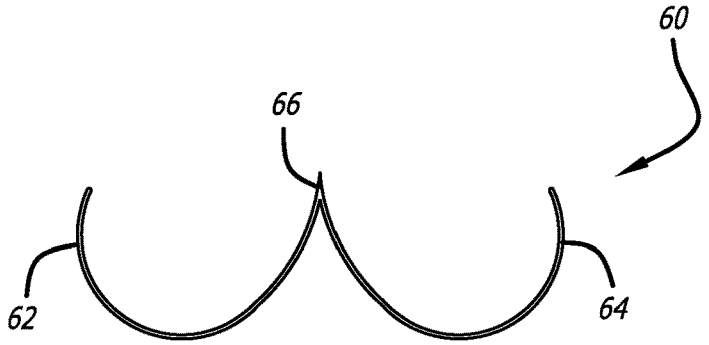
FIG. 7
FIG. 8
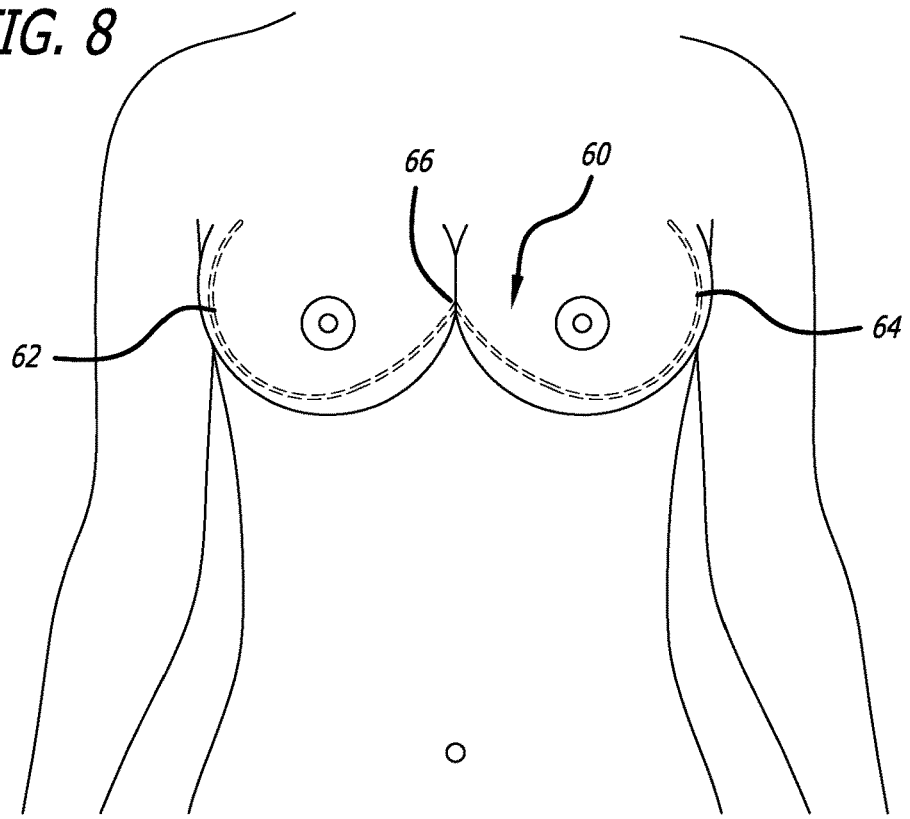

BRASSIERE

BACKGROUND OF THE INVENTION

Brassieres are worn by nearly all women of the Western world. Though whether the breast requires support to prevent sagging has been debated, women often seek to avoid the unwanted attention that arises from being braless in public. Bras prevent lateral and vertical movement, may provide nipple coverage, prevent accidental exposure of the breast, and allow a woman to create a desired breast shape or size.

Large breasts require more support than small breasts due to their size and a center of mass that is further from the rib cage. In order to provide the additional structure needed, the underwire bra was developed that incorporates a wire that is relatively inflexible. Often the wire extends from one cup to the other, joined by cloth and or man-made materials, to prevent independent side-to-side movement of the breasts, or one wire per cup supporting each breast and joined at the sternum.

Women's high-fashion trends over the past decade or so have been marked by an increase in the amount of skin that is revealed. This is especially true with evening gowns and cocktail dresses. With each more daring design, women are faced with the task of finding a brassiere that performs the task of providing support and a desired amount of coverage, while remaining hidden by the garment.

As such, fashion trends often give rise to corresponding undergarment innovations. Dresses that leave the shoulders bare, or have "spaghetti straps" spurred the invention of the strapless bra. The use of sheer material resulted in bras constructed of "nude" material—fabric colors that closely match the skin tone of the user.

Dresses that have plunging necklines and/or backs that drape down to the lower back have proven particularly challenging to bra designers. If the neckline plunges past the sternum, the connection between the cups of the bra becomes visible. Solutions to this problem have included a U-shaped connecting wire, or a clear plastic connector. Bras that have a connector in front require a strap that extends around the wearers back to counteract the forces placed on the cups by the front connector.

When the dress has a back that drapes down to the lower back, the bra typically has a back strap that crosses low on the back and also includes a strap that extends around the neck of the wearer and is either hidden by the wearer's hair or corresponding dress fabric.

Recently, daring dresses have become popular that incorporate both a plunging neckline, sometimes down to the navel, and a draping back that leaves most of the woman's back exposed. This style has heretofore left the woman with few choices. She is faced with using adhesive, independent cups, adhesive nipple covers, two-sided dress tape, or wearing nothing under the dress.

The adhesive, independent cups provide a minimal amount of support but may give a desired shape to the breast, provide nipple coverage, and have a tacky outer surface that reduces the risk of accidental exposure. The adhesive nipple covers provide nipple coverage and may be used in conjunction with two-sided tape to prevent accidental exposure, but provide no breast support. Using two-sided tape alone may prevent accidental exposure but allows the nipples to be seen through the dress if the dress fabric is thin. All of these three adhesive products are problematic in that they lose their adhesive qualities if they become damp. Thus, using them in warm and/or humid conditions is risky. They are also disposable or, at best, reusable only a few times.

The use of adhesive, independent cups, as stated above, is the only present solution that provides any support. Because these cups are applied directly to the breast, and have no connection to each other, they do little to control side-to-side movement of the breasts. This is typically not a problem for women with small breasts but large breasts that sway laterally, and independent of each other, tend to gain unwanted attention. As such, there is a need for a more supportive brassiere that can be worn under a dress with an open back and plunging necklines. There is a especially a need for a brassiere that remains hidden by such a dress while preventing lateral movement, regardless of breast size.

OBJECTS AND SUMMARY OF THE INVENTION

One aspect of the invention is directed to a bra that remains hidden by a dress with a plunging neckline and an open back, or similar garment, such as a shirt simulating a v-plunge, design that exposes the back and front torso.

Another aspect of the invention is directed to a bra that prevents lateral movement of the breasts.

Another aspect of the invention is an underwire bra that is characterized by an absence of shoulder straps or back straps and accommodating of a dress, or garment, having a plunging neckline.

Another aspect of the invention is a bra that includes underwire cups that are connected by a V-shaped or U-shaped connector that has a lower portion affixed to a belt or waist strap that holds the bra to the wearer's body.

Another aspect of the invention is a bra that includes two underwire cups connected directly together and configured and sized such that the cups pull the breasts together, causing the breasts to conceal the bra.

Another aspect of the invention is a bra that includes underwire cups that are connected by a continuous V-shaped or U-shaped connector, such as a pre-formed wire of metal, composite or man-made material, that extends from the breast cups down to the lower portion of the front torso, and has a lower portion affixed to a belt or waist strap that holds the V-shaped wire bra to the wearer's body.

Another aspect of the invention is a bra that includes underwire cups that are connected by a V-shaped or U-shaped connector, such as a pre-formed wire of metal, composite or man-made material, that extends from the breast cups down to the lower portion of the front torso, that when expanded laterally and placed onto the breasts will retract to its preformed shape, and the tension of the wire bra secures the breasts in place on the torso.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which

FIG. 3 is a front view of the embodiment of FIG. 1 donned by a wearer;

FIG. 4 is a side view of an embodiment of a device of the invention;

FIG. 7 is a front view of an embodiment of a device of the invention;

FIG. 8 is a front view of the embodiment of FIG. 7 donned by a wearer; and, FIG. 9 is a front view of an embodiment of a device of the invention.

DESCRIPTION OF EMBODIMENTS

Figure 1:
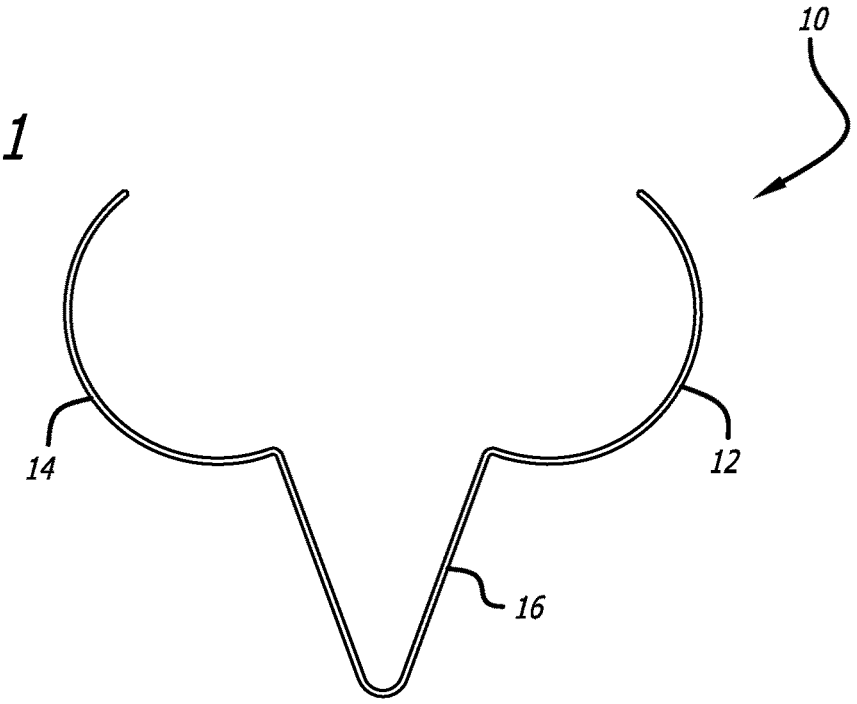
FIG. 1 is a front view of an embodiment of a device of the invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Referring now to the Figures and first to FIG. 1, there is shown an embodiment 10 of a bra of the invention. The bra 10 is preferably strapless and backless. Embodiment 10 includes a left underwire portion 12, a right underwire portion 14 connected to the left underwire portion 12 by a connector 16. The left and right underwire portions are generally semicircular and extend well up the outsides of the breasts of the wearer to prevent lateral movement of the breasts.

The connector 16 of embodiment 10 is generally U or V shaped and is constructed of a flexible material having spring-like properties. The U or V shape of the connector 16 extends the amount of cleavage that may be displayed while the bra 10 remains concealed by a dress.

Figure 2:
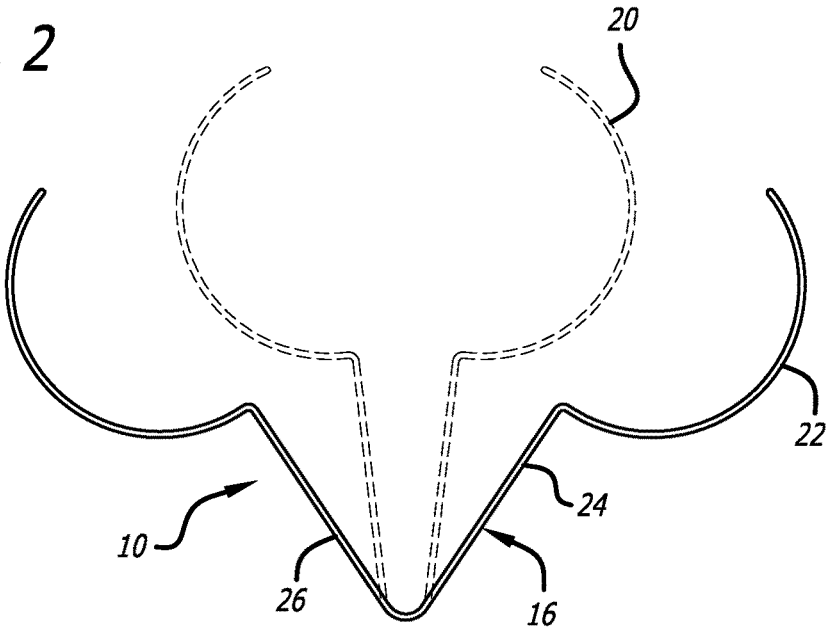
FIG. 2 is a front view of the embodiment of FIG. 1 showing an expanded state and a contracted state.

Referring to FIG. 2, it can be seen that the spring properties of the connector 16 allow the connector 16 to have a first, at rest configuration 20 (shown in phantom lines), and a second, stretched or separated configuration 22 when the bra 10 is being worn by a user. In use, the connector 16 is placed in the second configuration 22 by either pulling the underwire portions 12 and 14 apart, or alternatively pulling arms 24 and 26 of the connector 16 apart. While in the second configuration 22, the underwire portions 12 and 14 are placed on the outsides of the breasts, near the rib cage. The bra 10 is gently released, allowing the underwire portions 12 and 14 to squeeze the breasts together. When the underwire portions 12 and 14 are placed correctly against the ribcage, the sides of the breasts will naturally extend laterally outward of the underwire portions 12 and 14, as seen in FIG. 3. The sides of the breasts will thus assist in ensuring that the bra 10 does fall off of the user.

Keeping the bra 10 in place may be enhanced in several ways. For example, as seen in FIG. 4, the underwire portions 12 and 14 may include blades 30, herein defined as flat surfaces of increased width, to assist in drawing the breasts together as well as providing increased comfort to the wearer. These blades 30 may include a rubber, polymer, coating, texture, or other feature that assists in gripping the sides of the breasts to prevent slipping or migration of the bra 10.

Figure 5:
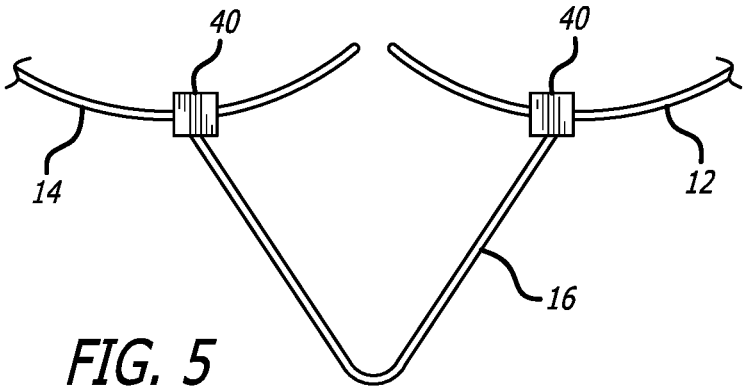
FIG. 5 is a partial front view on an embodiment of a device of the invention.

FIG. 5 shows an optional feature of bra 10, namely, an adjustable connection 40 between the connector arms 24 and 26, and the underwire portions 12 and 14, respectively. The connection 40 includes a mechanism 42 for loosening the connection 40. When loosened, the connection 40 allows the underwire 12 or 14 to slide laterally, relative to the connector arm 24 or 26. When the mechanism 42 is tightened, the underwire 12 or 14 is fixed relative to the arm 24 or 26, respectively.

The adjustable connection 40 provides several advantageous features. For example, adjustability allows the bra 10 to be sized to fit various women. Not only does this customization provide the best possible fit for an individual user, it greatly reduces manufacturing costs as fewer sizes are required to be manufactured. The adjustability also allows an individual user to adjust the amount of spring tension acting on the breasts. Adjusting the connection 40 to a point closer to an outside end of an underwire requires the user to stretch the bra 10 further when donning the bra. This increases the amount of inward spring force placed on the breasts, thereby increasing the amount of cleavage or apparent breast size. Conversely, decreasing the amount of spring force may create a more natural appearance with less support and more space allowed between the breasts.

Additionally, the connection 40 may be constructed and arranged to allow the connector 16 to be removed completely from the underwire portions 12 and 14. This feature allows various sizes and shapes of connectors 16 to be used with various sizes, shapes and colors of underwire portions 12 and 14, or cups if the underwire portions 12 and 14 include a cloth cup, as discussed below.

Figure 6:
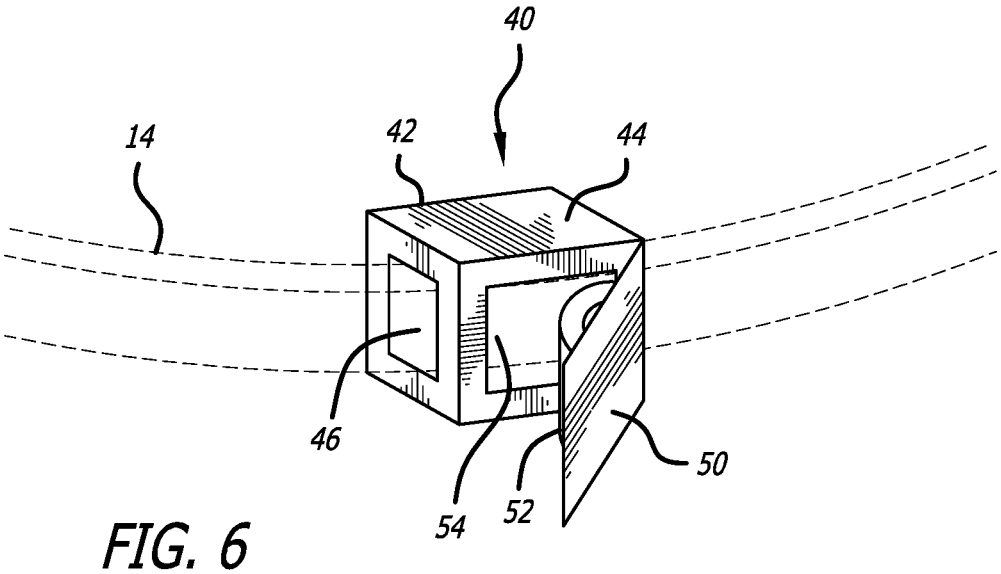
FIG. 6 is an expanded perspective view of a connector of an embodiment of a device of the invention.
Figure 9:
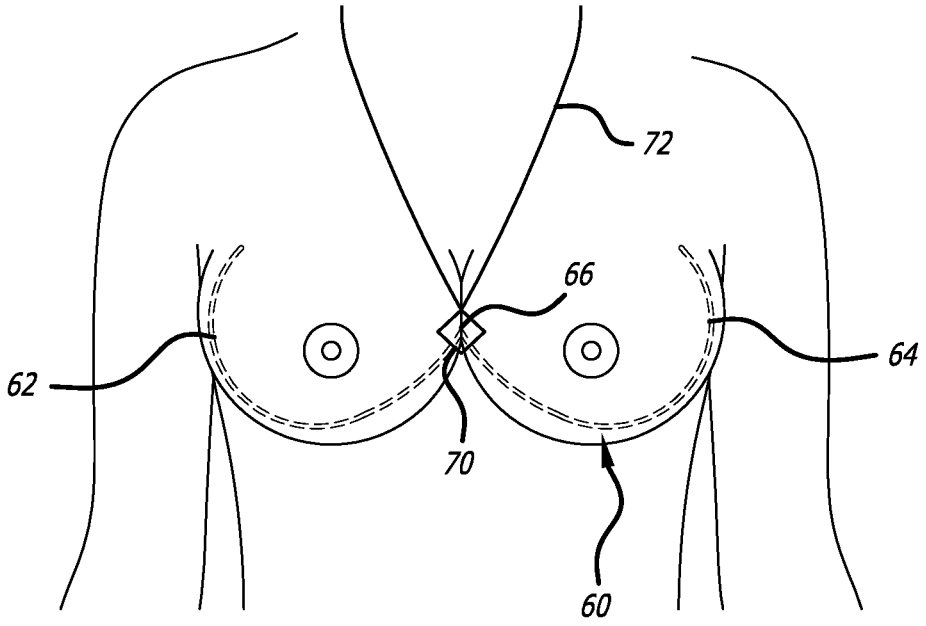

Possible mechanisms 42 include, but are not limited to, set screws, spring clips, ratcheting slides, hook and loop fasteners, snaps, buckles, laces, and the like. FIG. 6 shows an example of a mechanism 42 that includes a housing 44 defining a channel 46 for receiving a correspondingly shaped and sized underwire portion 12 or 14. A lever 50 is pivotally attached to the housing 44 and includes a clamp 52 that slides through an opening 54 when the lever 50 is rotated to a closed position. A cam 56 provides a snap lock effect, keeping the lever 50 in the closed position until the lever is intentionally rotated to the open position. When in the closed position, part of the clamp 52 enters the channel 46 and acts against the underwire portion 12 or 14, thereby fixing the position of the connection 40 with the underwire portion 12 or 14.

FIGS. 7 and 8 show and embodiment 60 of a brassiere of the invention that is designed to remain completely hidden underneath the breasts. The brassiere is preferably strapless and backless. The embodiment 60 is formed, preferably, out of a single piece of resilient material. In FIG. 7, the brassiere 60 is shown in a relaxed configuration, having cups 62 and 64 connecting at point 66. The cups 62 and 64 are flexible and, in the relaxed configuration, are in close proximity to each other.

In use, the cups 62 and 64 are spread apart and placed around the breasts, as shown in FIG. 8. Once released, the resiliency of the cups 62 and 64 causes them to be biased inwardly, thereby squeezing the breasts together in a desirable fashion, giving a youthful appearance to the breasts and creating cleavage, rather than natural separation, between the breasts. The cleavage then acts to conceal the connection point 66. Additionally, the weight of the breasts acting against the brassiere 60 prevents the brassiere 60 from falling off of the wearer. In order to increase comfort and grip, the cups 62 and 64 may be coated with a soft coating, or may be equipped with blades such as blades 30 shown in FIG. 4.

As seen in FIG. 1*f* it is not desired to create enough cleavage to completely conceal the brassiere 60, it is envisioned that a decorative feature 70 could be placed over the connection point 66. A necklace 72 could then be attached to the feature 70 to create the illusion that the feature 70 is a pendant worn around the neck of the user. This necklace could be further used as a bra strap, if additional lift is desired.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A backless support device comprising:

a left underwire portion;

a right underwire portion, a connector attaching the left underwire portion to the right underwire portion;

wherein said connector has a shape characterized by a middle that extends downward relative to the left and right underwire portions when worn by a user;

wherein when worn by the user, the backless support device is present only on a front and sides of the user's torso.

2. The support device of claim 1 wherein said connector comprises an elastic material.

3. The support device of claim 1 wherein the shape comprises a U-shape.

4. The support device of claim 1 further including a resting configuration and a stretched configuration in which the left and right underwire portions are separated from each other by a greater distance relative to a separation in the resting configuration, and wherein said support device is biased toward the resting configuration.

5. The support device of claim 1 wherein the left and right underwire portions include blades.

6. The support device of claim 5 wherein the blades comprise a gripping feature.

7. The support device of claim 6 wherein the gripping feature is selected from the group rubber, polymer, coating, texture.

8. The support device of claim 1 wherein the connector comprises first and second connector arms separated by an adjustable connection.

9. The support device of claim 1 further comprising left and right cups and wherein the left and right underwire portions are incorporated into the left and right cups, respectively.

10. A method of reducing lateral breast movement comprising:

providing a support device having first and second underwire portions connected by a connector;

stretching the first and second underwire portions away from each other by pulling and holding the underwire portions apart while donning the support device;

placing at least one of each underwire portions on an outside surface of a respective breast;

releasing said underwire portions.

11. The method of claim 9 further comprising adhering at least a portion of the underwire portions to the respective breast.

12. The method of claim 9 further comprising operating a connection mechanism allowing a user to adjust a separation distance between the first and second underwire portions.

13. A support device for female breasts comprising a single piece of resilient material shaped to form first and second cups joined only with a central connector, said support device stretchable from a rest configuration to a stretched configuration, wherein when worn by a wearer in a stretched configuration, said support device is at least partially held in place by an interaction between a spring force placed on the wearer by the first and second cups and a resistance to returning to the rest configuration, placed on the support device by breasts of the wearer.

14. The support device of claim 13 wherein the support device is configured such that, when worn by the wearer, the central connector is located such that the central connector may be hidden by cleavage created by the brassiere.

15. The support device of claim 13 further comprising a coating applied to said first and second cups thereby increasing comfort and grip.

16. The support device of claim 13 further comprising a decorative pendant attached to the central connector.

17. The support device of claim 16 further comprising a necklace attached to the pendant.

18. The support device of claim 17 wherein the necklace serves as a bra strap usable to adjust an amount of support provided by the support device.

19. The support device of claim 13 wherein the first and second cups include blades providing increased surface contact area.

* * * * *